US006545657B2

(12) United States Patent
Aoki

(10) Patent No.: US 6,545,657 B2
(45) Date of Patent: Apr. 8, 2003

(54) LIQUID CRYSTAL APPARATUS, DRIVING METHOD THEREOF, AND PROJECTION-TYPE DISPLAY APPARATUS AND ELECTRONIC EQUIPMENT USING THE SAME

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/924,510

(22) Filed: Aug. 9, 2001

(65) Prior Publication Data

US 2002/0024486 A1 Feb. 28, 2002

Related U.S. Application Data

(62) Division of application No. 09/254,688, filed as application No. PCT/JP97/03601 on Oct. 8, 1997, now Pat. No. 6,307,532.

(30) Foreign Application Priority Data

Jul. 16, 1997 (JP) ..... 9-207074

(51) Int. Cl.[7] ..... G09G 3/36

(52) U.S. Cl. ..... 345/94; 345/99; 345/100

(58) Field of Search ..... 345/94, 87–93, 345/95–104, 208–210, 204; 377/64, 69, 77, 78

(56) References Cited

U.S. PATENT DOCUMENTS 4,963,860 A * 10/1990 Stewart ..... 340/719
5,510,807 A * 4/1996 Lee et al. ..... 345/103

FOREIGN PATENT DOCUMENTS

JP 63-041829 A * 1/1988
JP 63-41829 2/1988
JP 2-204718 8/1990
JP 02-204718 A * 8/1990
JP 04-321093 A * 11/1992
JP A-4-321093 11/1992
JP 4-321093 11/1992
JP 07-104703 A * 4/1995
JP 7-104703 4/1995
JP A-7-104703 4/1995
WO WO 94/16428 * 7/1994

* cited by examiner

*Primary Examiner*—Lun-Yi Lao
(74) *Attorney, Agent, or Firm*—Oliff & Berridge, PLC

(57) ABSTRACT

A liquid crystal apparatus for preventing deterioration of image quality owing to delay of the signal transporting speed at the time of switching, due to parasitic capacity and parasitic resistance in the pre-charging signal supply path and horizontal scanning signal supply path. The time interval (T4) from the point of the end of the pre-charging period T12 within the m'th horizontal scanning period to the point of the start of the leading sampling period in the m'th horizontal scanning period has been set so as to be longer than the signal transporting delay time at the pre-charging switch (172) connected to the data signal line S1. Accordingly, the time interval (T1) from the end of the pre-charging period (T2) to the point at which the shift data signal (DX) of the X-driver (104) becomes active has been set so as to be longer than the signal transporting delay time at the pre-charging switch (172) connected to the data signal line S1. Further, the time interval (T3) from the point of the end of the (m−1)th horizontal scanning period to the point of the start of the pre-charging period (T2) set within the m'th horizontal scanning period has been set so as to be longer than the signal transporting delay of the horizontal scanning signal h(m−1) reaching the pixel A(m−1, x) positioned farthest away from the Y-driver (102).

10 Claims, 17 Drawing Sheets

FIG. 9

| | S1 | S2 | S3 | S4 |
|---|---|---|---|---|
| H1 | + | − | + | − |
| H2 | − | + | − | + |
| H3 | + | − | + | − |
| H4 | − | + | − | + |

FIG. 10

| | S1 | S2 | S3 | S4 |
|---|---|---|---|---|
| H1 | − | + | − | + |
| H2 | + | − | + | − |
| H3 | − | + | − | + |
| H4 | + | − | + | − |

LIQUID CRYSTAL APPARATUS, DRIVING METHOD THEREOF, AND PROJECTION-TYPE DISPLAY APPARATUS AND ELECTRONIC EQUIPMENT USING THE SAME

This is a Divisional of application Ser. No. 09/254,688 filed Mar. 15, 1999, now U.S. Pat. No. 6,307,532, which in turn is a National Stage of PCT/JP97/03601, Oct. 8, 1997 the entire disclosure of the prior application(s) is hereby incorporated by reference herein in its entirety.

BACKGROUND OF THE INVENTION

1. Field of Invention

The present invention relates to a liquid crystal apparatus, a driving method thereof, and a projection-type display apparatus and electronic equipment using the liquid crystal apparatus.

2. Description of Related Art

For example, with an active-matrix liquid crystal apparatus, action of writing data to the liquid crystal layer of each pixel is executed by line-at-a-time driving, via switching elements such as a plurality of TFTs (thin-film transistors) connected to a scanning signal line.

Also, in order to eradicate unevenness in the display owing to imbalance in voltage applied to the liquid crystal, and in order to prevent deterioration and so forth of the liquid crystal due to the direct current applied to the liquid crystal, polarity inversion driving is performed, wherein the polarity of the voltage applied to the liquid crystal is inverted at a certain timing.

Polarity inversion driving is a method of driving wherein voltage is applied to one end of the liquid crystal, the polarity (positive or negative polarity) of this voltage is opposite to a reference potential applied to the other end of the liquid crystal.

Incidentally, in the present Specification, the term "polarity" refers to the polarity of the voltage applied to both ends of the liquid crystal. In order to perform polarity inversion driving with an active-matrix type device using TFTs, either the potential applied to the common electrode opposing the pixel electrode across from the liquid crystal is changed, or the potential level of the image data signal is changed with reference to the center potential of the voltage amplitude of the image data signal applied to the pixel electrode.

Known types of polarity inversion driving methods involve inversion by the line wherein polarity inversion is performed each time a scanning signal line is selected, or inversion by the line combined with inversion by the dot wherein polarity inversion is performed for each pixel connected to one scanning signal line.

FIG. 9 and FIG. 10 are models for describing the polarity inversion driving method. With conventional active-matrix liquid crystal apparatus, a polarity inversion driving method has been employed wherein line-at-a-time driving is performed and inversion is performed for each pixel (including for each line), and wherein pre-charging of the data signal lines is performed collectively during the blanking period immediately before.

In FIG. 9 and FIG. 10, S1 through S4 represent data signal lines, and H1 through H4 represent scanning signal lines. The "+" and "−" for each pixel represent the voltage applied to the liquid crystal of each pixel, and the polarity of the pre-charge potential supplied to the data signal lines immediately prior to the application of the voltage. FIG. 9 represents the voltage polarity of each pixel at field N, and FIG. 10 represents the voltage polarity of each pixel at field N+1. Regarding polarity inversion driving per pixel and per line, the arrangement is such that differing polarity voltage is applied to each neighboring pixel connected to the same data signal line (each neighboring pixel in the vertical direction in FIG. 9 and FIG. 10).

In this case, even when writing the same black data, for example, on the display to two neighboring pixels which are connected to the same data signal line and connected to different scanning signal lines, the signal level for each of the pieces of black data differs, due to the polarity inversion driving. At this time, since the data signal line itself has parasitic capacity, so time is required for changing the potential of the data signal line from the black level potential on the positive polarity side to the black level potential on the negative polarity side.

With reference to FIG. 11 and FIG. 12, description will be made regarding change in the potential of the data signal line when writing the same black data to two neighboring pixels which are connected to the same data signal line.

In FIG. 11, C10 represents the parasitic capacity of the data signal line S1 (i.e., the equivalent capacity of the data signal line S1). Also, the "−" and "+" noted on the left side of FIG. 11 represents the polarity of the voltage written to the pixels 22 and 24. Incidentally, the pixels 22 and 24 are both to display "black". The pixels are comprised of a storage capacity and a pixel electrode to which data signals are supplied via a switching element, and a liquid crystal layer to which voltage is applied between the pixel electrode and common electrode.

As shown in FIG. 12, during the horizontal scanning time T1, black level potential B1 is applied to one end of the pixel 22 and black is displayed, and during the next horizontal scanning time T2, black level potential B2 is applied to one end of the pixel 24 and black is displayed, in the same manner. In this case, since a common electrode potential which is set between the black levels B1 and B2 is applied to the other end of the pixels 22 and 24, so that voltage of a negative polarity is applied to the pixel 22, and voltage of a positive polarity is applied to the pixel 24, thus inverting the polarity of the voltage applied to the liquid crystal for the same black display. Moreover, with a normally-white display such as described above, the difference in potential between the black level potentials B1 and B2 is the greatest, as compared with display of other gray scales. Accordingly, in the event that pre-charging is not performed, the parasitic capacity C10 of the data signal line S1 must be charged (or discharged) by the image data signal itself, so as to change the potential of the data signal line from the black level potential B1 to B2, as represented by "R1" in the Figure.

Conversely, by performing pre-charging of the same polarity as the polarity of the data signal before supplying the data signal, i.e., by performing pre-charging before the horizontal scanning time T2 so as to maintain the data signal line S1 at the high-voltage second pre-charging potential PV2, as shown as "R2" in the Figure, all that is necessary is to change the potential of the data signal line from the second pre-charging potential PV2 to the black level potential B2, so the amount of charging (discharging) of the parasitic capacity C10 of the data signal line S1 does not have to be great. Accordingly, driving of the liquid crystal is increased in speed.

Now, regarding a conventional liquid crystal apparatus, the arrangement has been such that the black level potentials B1 and B2 are respectively set at 1V and 11V, the white level potentials W1 and W2 are respectively set at 5V and 7V, and the pre-charging potentials PV1 and PV2 are respectively set at 4V and 8V. That is to say, the pre-charge potentials PV1 and PV2 have been set symmetrically to the center potential (6V) between the black level potentials B1 and B2, which are the video amplitude.

The 4V and 8V are voltages which are applied to one end of the liquid crystal via a switching element at the time of displaying intermediate gray scale, and are equivalent to the potential level at the time that the T-V curve, which represents the relation between the voltage applied to the liquid crystal (V) and the transmittance of the liquid crystal apparatus (T), becomes the steepest. In other words, 4V and 8V are equivalent to potential levels at the time that the change in transmittance corresponding to change in voltage applied to the liquid crystal is the greatest. By setting the pre-charging potentials PV1 and PV2 as such, the data signal line can be charged or discharged in a short time from the pre-charging potential to a potential for intermediate gray scale display, so accurate intermediate display can be realized even in the event that the sampling period is reduced.

Now, as described above, image display devices have come to be used for various purposes, such as liquid crystal monitors, notebook-type personal computers, and household equipment. Accordingly, development has been proceeded from the perspective of improving precision and portability thereof. For example, regarding improving precision, development has been proceeded toward a display devices with more pixels, e.g., from VGA (640×480 pixels) to XGA (1024×768 pixels), from XGA to SXGA (1280×1024 pixels), from SXGA to UXGA (1600×1200 pixels).

The operating frequencies of the above image display devices differ according to the types of image data signals. For example, VGA is used for monitors for notebook personal computers, and the operating frequencies are 60 Hz, 72 Hz, and 75 Hz. SVGA, for example, is used for monitors for notebook personal computers larger than VGA, and the operating frequencies are 56 Hz, 60 Hz, 72 Hz, and 75 Hz. Further, for example, XGA is used for monitors for desktop personal computers and notebook personal computers, and the operating frequencies are 60 Hz, 70 Hz, and 75 Hz. Also, for example, the operating frequency of EWS (SXGA) is 75 Hz.

For example, in the case that a VGA specifications (60 Hz) device is used for a liquid crystal apparatus, there are 800 dot clock signals in 31778 $\mu$sec in one horizontal scanning period, having 640 clocks worth within the effective display period. Accordingly, in the event that the aforementioned driving frequencies of 56, 60, 72, and 75 Hz are applied to this device, the period for each horizontal scanning period is shortened. Also, the image data signals input externally can be compressed or extended by digital processing, thereby performing image display corresponding with each of the image data signals.

Also, such liquid crystal apparatus are applied to projectors and the like, and in this case, the arrangement is such that image display can be carried out by performing compression and expansion of the image data signals appropriately, even in the case that the type of image data signal is switched from one to another.

In according with such increase in the number of pixels in image display devices, the size of liquid crystal panels is increasing, and along with this, irregularities in the image on the image display devices is becoming more recognizable. Against the image irregularities, a measure that is improving the uniformity of the pixels and back-lighting has been taken, thereby reducing irregularities in brightness and color.

However, though various steps are being taken regarding the increased frequency which accompanies the increase in the number of pixels, the switching elements in liquid crystal apparatus are comprised of TFTs. Accordingly, there is the problem that the switching properties are slow not only in data signal sampling but also in pre-charging, and accordingly, study is being made regarding various circuit operations accompanying them.

Also, to the scanning signal line, TFT gates serving as switching elements, the number of which is the equal to the number of pixels in the X-direction, are each connected so the capacity component for the scanning'signal line increases. Also, increased panel size means that the wiring resistance of the scanning signals lines increases. Accordingly, the parasitic resistance and parasitic capacity in the scanning signal lines increases and becomes a load, which in turn causes problems of wiring delays.

The present invention has been made in light of the above problems, and it is an object of the present invention to provide a liquid crystal apparatus a driving method thereof, a projection-type display apparatus and electronic equipment using the liquid crystal apparatus, which are capable of preventing deterioration of image quality due to delay of the signal transporting speed when switching, owing to parasitic capacity and parasitic resistance in the supply path of pre-charging signals and parasitic capacity and parasitic resistance in the switching elements.

It is another object of the present invention to provide a liquid crystal apparatus, a driving method thereof, a projection-type display apparatus and electronic equipment using the liquid crystal apparatus, which are capable of preventing deterioration of image quality due to delay of the signal transporting speed when switching, owing to parasitic capacity and parasitic resistance in the scanning signal lines and parasitic capacity and parasitic resistance in the switching elements.

It is a further object of the present invention to provide a liquid crystal apparatus, a driving method thereof, a projection-type display apparatus and electronic equipment using the liquid crystal apparatus, wherein there is no image deterioration even if image data signals of a different type are supplied to the liquid crystal apparatus, by setting the timing for pre-charging and sampling, using the start-up time of the data signal line driving circuit (X-driver) as a reference.

SUMMARY OF THE INVENTION

According to one aspect of the present invention, a liquid crystal apparatus is comprised of switching elements, which are electrically connected to pixels , being provided to each of a plurality of pixels formed by crossing a plurality of data signal lines and a plurality of scanning signal lines, driven by inverting the polarity of the voltage applied to the pixels at a predetermined interval, and also comprises: scanning-side driving circuit for sequentially supplying to the plurality of scanning signal lines horizontal scanning signals which turn a plurality of switching elements connected to at least one of the plurality of scanning signal lines turn on during the horizontal scanning period; a plurality of sampling switching circuits which are connected to each of the plurality of data signal lines, sequentially sample data signals during the sampling period, and supply the data signals to each of the plurality of data signal lines; data-side driving circuit for supplying the signals which set the sampling period to the plurality of sampling switching circuits; and a plurality of pre-charging switching circuits which simultaneously pre-charge each of the plurality of data signal lines with a pre-charge potential which has the same polarity as the voltage applied to the liquid crystal layer of the pixels based on the data signals, during the pre-charging period preceding the sampling period wherein the data signals are sequentially supplied to each of the plurality of data signal lines; wherein the time interval from the point at which the pre-charging period ends within a horizontal scanning period to the point that the sampling period of the leading sampling switching circuit is started, is set to be longer than the signal transporting delay time of the sampling switching circuits connected to the data signal line.

According to the one of the embodiments of the present invention, image deterioration can be prevented even in the event that a signal transport delay time occurs in each of the plurality of pre-charging switching circuits following the end of the pre-designed pre-charging period. This is because following all of the pre-charging switching circuits turning off, data sampling to each of a plurality of data signal lines is initiated. Accordingly, even at the data signal lines of which the sampling period is started firstly in the horizontal scanning period in particular, it is possible to avoid the situation in which both of the pre-charging switching circuit and the sampling switching circuits connected thereto turn ON at the same time. Thus, the data signal potential written to the data signal lines is not undesirably affected by the pre-charging potential, and there is no shift in the gray scale value at pixels connected to the data signal lines.

It is preferable that the time interval from the point at which the pre-charging period ends to the point that the leading sampling period within a horizontal scanning period is started is set to be longer than the sum of the time-constants based on the load of each of the pre-charging switching circuits. Thus, the time interval becomes longer than the signal transporting delay time at the pre-charging switching circuit.

The data-side driving circuit can be arranged so as to output the sampling signals after the shift data signal for starting the data-side driving circuit is activated. In this case, the time interval longer than the signal transporting delay time should be set to be the time from the point of end of the pre-charging period to the point to activating the shift data signal.

The present invention may include an adjusting circuit for adjusting and setting the time interval from the point at which the pre-charging period ends to the point that the sampling period of the leading sampling switching circuit within a horizontal scanning period is started.

This adjusting circuit comprises: a counter for counting reference clock signals and being reset by horizontal synchronizing signals; a decoder for decoding the output of the counter and outputting signals for setting the time interval; and a signal generating circuit for generating the pre-charging signals and the shift data signals, based on the output of the decoder. The pre-charging signal and shift data signal can be generated after elapsing of the above time interval, by this adjusting circuit.

Also, the adjusting circuit can fix the time interval, regardless of the driving frequency. Accordingly, image quality never drops, even in the event that image data signals of various types with differing driving frequencies are supplied.

According to another aspect of the present invention, a liquid crystal apparatus is comprised of switching elements, which are electrically connected to pixels, being provided to each of a plurality of pixels formed by crossing a plurality of data signal lines and a plurality of scanning signal lines, is driven by inverting the polarity of the voltage applied to the pixels at a predetermined interval, and also comprises: at least one scanning-side driving circuit for sequentially supplying to the plurality of scanning signal lines horizontal scanning signals which turn ON a plurality of switching elements connected to at least one of the plurality of scanning signal lines during the horizontal scanning period; a plurality of sampling switching circuits which are connected to each of the plurality of data signal lines, sequentially sample data signals during the sampling period, and supply the data signals to each of the plurality of data signal lines; data-side driving circuit for supplying the signals which set the sampling period to the plurality of sampling switching circuits; and a plurality of pre-charging switching circuits which pre-charge each of the plurality of data signal lines with a pre-charge potential which simultaneously has the same polarity as the voltage applied to the liquid crystal layer of the pixels based on the data signals, during the pre-charging period preceding said sampling period wherein the data signals are sequentially supplied to each of the plurality of data signal lines; wherein the time interval from the point at which the (m−1)th horizontal scanning period ends to the point that the pre-charging period set within the m'th horizontal scanning period is started, is made to be longer than the signal transporting delay time of the horizontal scanning signal reaching the pixel at the farthest position from the at least one scanning-side driving circuit.

This other aspect of the present invention prevents deterioration of the image quality at the pixel, by taking note of the fact that the signal transporting delay time of the horizontal scanning signal reaching the pixel that is farthest from the scanning-side driving circuit is the longest. With the liquid crystal apparatus, even if the pre-designed (m−1) th horizontal scanning period ends, the actual horizontal scanning period of the (m−1)th is extended based on the signal transporting delay time. According to the present invention, the pre-charging period of the m'th horizontal scanning period starts after the elapsing of the longest delay time of the signal transportation. Accordingly, the pixels connected to the plurality of switching elements, which is turned ON during the (m−1)th horizontal scanning period, are not undesirably affected by the pre-charging potential for the m'th horizontal scanning period.

It is preferable that the time interval, which is from the point of the end of the (m−1)th horizontal scanning period until the point of the start of the pre-charging period being set within the m'th horizontal scanning period, is set to be longer than the sum of the time-constants based on each of the loads of one scanning signal line and the switching element of the farthest pixel. Thus, the above mentioned time interval can be made to be longer than the signal transporting delay time of the horizontal scanning signal reaching the pixel that is farthest from the scanning-side driving circuit.

The present invention can include an adjusting circuit for adjusting and setting the time interval from the point at which the (m−1)th horizontal scanning period ends to the point that the pre-charging period being set within the m'th horizontal scanning period is started.

The adjusting circuit comprises: a counter, which counts reference clock signals and is reset by horizontal synchronizing signals; a decoder for decoding the output of the counter and outputting signals for setting the time interval; and a signal generating circuit for generating the pre-charging signals and the shift data signals, based on the output of the decoder. According to this adjusting circuit, the pre-charging signal for the m'th horizontal scanning period can be generated, after the above time interval elapses following the end of the (m−1)th horizontal scanning period.

Also, the adjusting circuit can fix the time interval, regardless of the driving frequency. Accordingly, image quality never drops, even in the event that image data signals of various types with differing driving frequencies are supplied.

Each of the above-described inventions can comprise a pair of substrates with the liquid crystal sandwiched therebetween, wherein the plurality of sampling switching circuits can be formed by a plurality of switching elements provided on one of the pair of substrates. Such switching element may be a MOS transistor or thin-film transistor.

Also, applying the present invention to a projection-type display device or electronic equipment having a liquid crystal apparatus with the above characteristics can prevent image deterioration therein.

DETAILED DESCRIPTION OF PREFERRED EMBODIMENTS

FIG. 9 is a schematic explanatory diagram illustrating polarity inversion operation in the N field;

FIG. 10 is a schematic explanatory diagram illustrating polarity inversion operation in the N+1 field;

Figure 2:
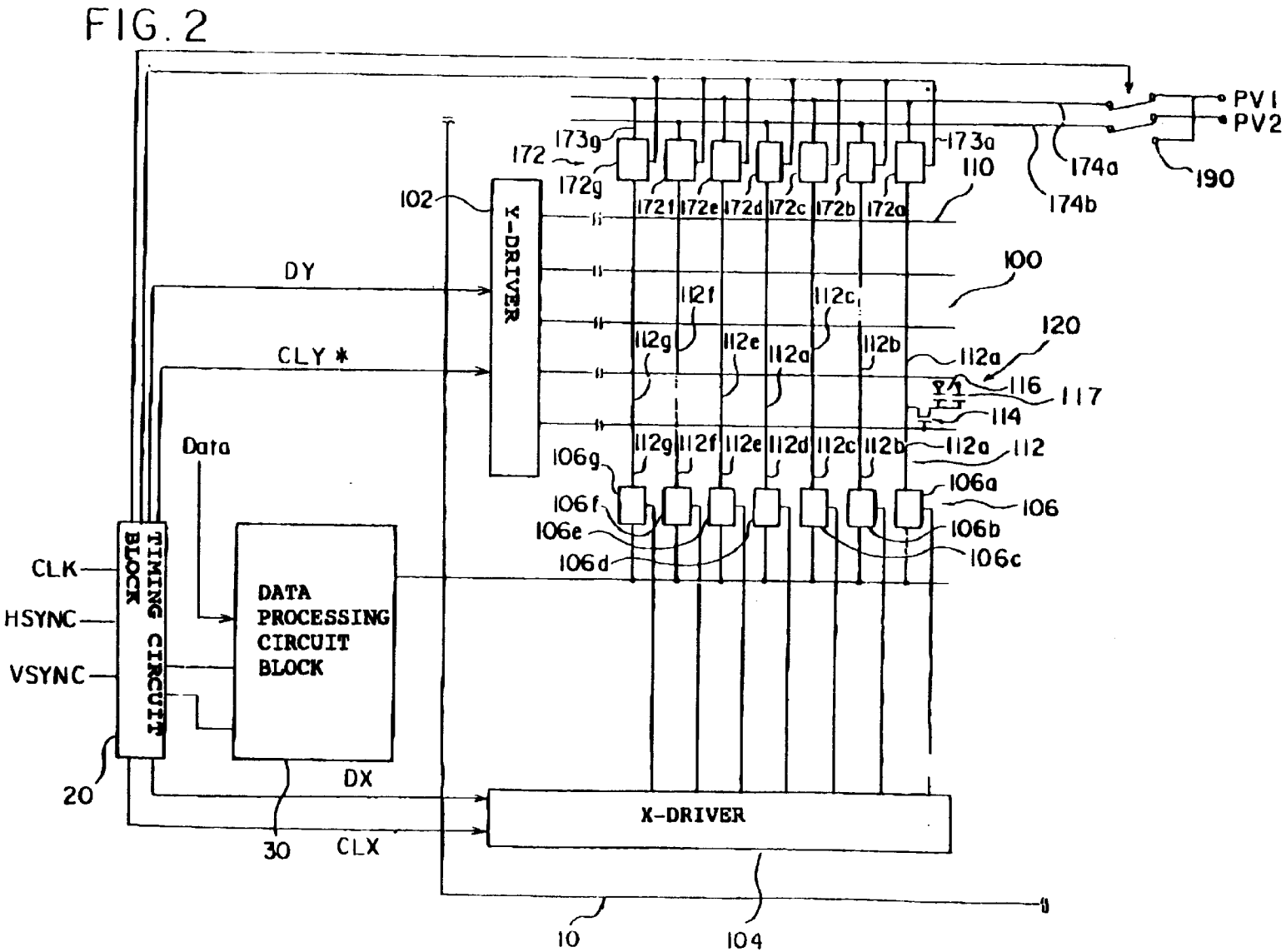
FIG. 2 is a schematic diagram of an active-matrix liquid crystal display apparatus according to a first embodiment of the present invention.

FIG. 2 shows an overall schematic view of the liquid crystal apparatus according to the first embodiment. As shown in the Figure, this liquid crystal apparatus is a small-sized liquid crystal apparatus used as a light valve for electronic equipment such as a liquid crystal projector, and can be generally divided into the liquid crystal panel block 10 the timing circuit block 20, and the data processing circuit block 30.

The timing circuit block 20 is for inputting/outputting X-driver shift clock signals CLX*, Y-driver shift clock signals CLY*, X-driver shift signals DX, Y-side shift data signals DY, and so forth, based on the dot clock signals CLK, horizontal synchronizing signals HSYNC, and vertical synchronous signals VSYNC. The timing circuit block 20 has a pulse variation function for setting the pulse width of the later-described pre-charging timing signal P.

The data processing circuit block 30 is a circuit block which processes data by amplifying, inverting, etc., the data so as to be appropriate for liquid crystal display. Also, data signals are generated by means of subjecting image data signals "Data" externally input to one pixel at a time to polarity inversion, with polarity inversion reference potential as a reference.

The liquid crystal panel block 10 is comprised of liquid crystal sealed between a pair of substrates, and a pixel area 100, a Y-driver 102, an X-driver 104, a sampling switch 106, and a pre-charging switch 172, which are provided on one of the substrate, and a common electrode, which are provided on the other opposing substrate. On the outer side of the pair of liquid crystal panel substrates, a polarizing plate is provided. Incidentally, these driving circuits may be separated from the liquid crystal panel substrates and comprise an external IC.

Formed on the pixel area 100 are a plurality of scanning signal lines 110 which extend in the row direction. For example, as shown in FIG. 2, and a plurality of data signal lines 112 which extend in the column direction, for example. Incidentally, in the present embodiment, although the description will be made with the total number of scanning signal lines 110 as 492 lines, and with the total number of data signal lines 112 as 652 lines, for the purpose of facilitating ease of description, the number of scanning signal lines or data signal lines is not particularly restricted, and if the greater the number of pixels are used in the liquid crystal apparatus, the greater the effects can be obtained.

At each position at which each of the signal lines 110 and each of the data signal lines 112 intersect, a switching element 114 and a pixel 120 are serially connected, thereby forming a display component. Each pixel 120 is comprised of pixel electrodes connected with the switching elements 114, these being formed together on one substrate, storage capacity 117 formed between the scanning signal lines and capacity lines neighboring each pixel electrode, a common electrode formed on the opposing other substrate, and a liquid crystal layer 116 sandwiched between both electrodes.

The period during the switching elements 114 of each pixel 120 are ON is referred to as "selected period", and period during the same are OFF is referred to as "non-selected period". The storage capacity 117 stores, during the non-selected period, the voltage which is supplied to the pixel 120 via the switching element 114 during the selected period, and the storage capacity is connected to the liquid crystal layer 116.

According to the present embodiment an example of a three-terminal type switching element is used for the switching element 114, such as a TFT (thin-film transistor). The switching element is not restricted to such, and a MOS transistor which is another type of three-terminal type switching element, or a two-terminal type switching element such as a MIM (metal-insulator-metal) element or a MIS (metal-insulator-semiconductor) element may be used. Incidentally, the pixel area in the present embodiment is not restricted to an active-matrix liquid crystal display panel using two-terminal or three-terminal type switching elements, rather, various types of liquid crystal panels such as passive-matrix liquid crystal panels, may be used.

The Y-driver 102 is comprised of a shift register and logic circuit. The shift register is input with the Y-side shift data signals DY and Y-side shift clock signals CLY* generated in the timing circuit block 20, and outputs horizontal scanning signals h1, h2, h3, and so forth, which have been set the selection period for sequentially selecting at least one scanning signal line 110 from the plurality of scanning signal lines 110*a*, 110*b*, and so forth (See FIG. 4).

The number of the shift register tiers of this Y-driver is equivalent to the number of scanning signal lines 110, and wherein the neighboring shift register tiers are connected one to another, and transfer of the Y-side shift data signal DY is sequentially performed.

Figure 4:
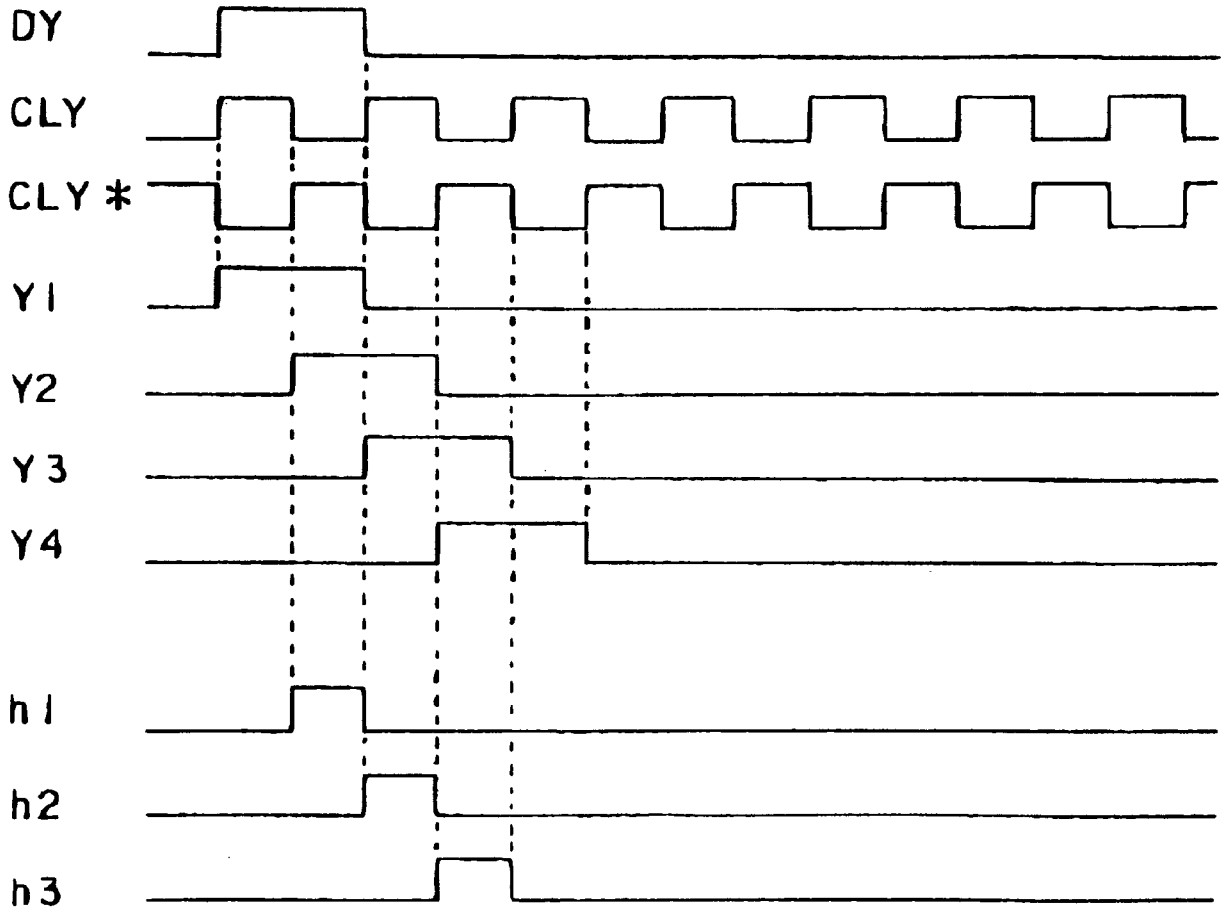
FIG. 4 is a timing chart for describing the operation of a Y-driver of an active-matrix liquid crystal display apparatus according to the first embodiment of the present invention.

The Y-side shift register output signals Y1, Y2, Y3, and so forth shown in FIG. 4 are output from each tier of the shift register. The horizontal scanning signal h1 is generated by the logical product of the Y-side shift register output signals Y1 and Y2. In the same manner, the horizontal scanning signals h2, h3, and so forth are generated by the logical product of the output Yn and Yn+1 of the two neighboring Y-side shift register tiers.

Accordingly, the horizontal scanning signals h1, h2, h3, and so for are output after the Y-side shift data signal DY is input.

The X-driver 104 is served for inputting the X-side shift block signal CLX* and X-side shift data signal DX which are generated in the timing circuit block 20, and also served for outputting the sampling signals S1, S2, S3, and so forth, which is for performing the line-at-a-time driving of the pixel area 100, to a plurality of sample holding switches 106 placed between e.g., one signal line which is an output line of the data processing logic block 30 and the data signal lines 112*a*, 112*b*, and so forth of the pixel area 100.

In the same manner as with the Y-driver 102, this X-driver 104 also includes a shift register having the tiers, the number of which is equivalent with the number of the plurality of data signal lines, and wherein the neighboring tiers of the shift register are connected each other, thereby performing sequential transfer of the X-side shift data signals DX.

Figure 1:
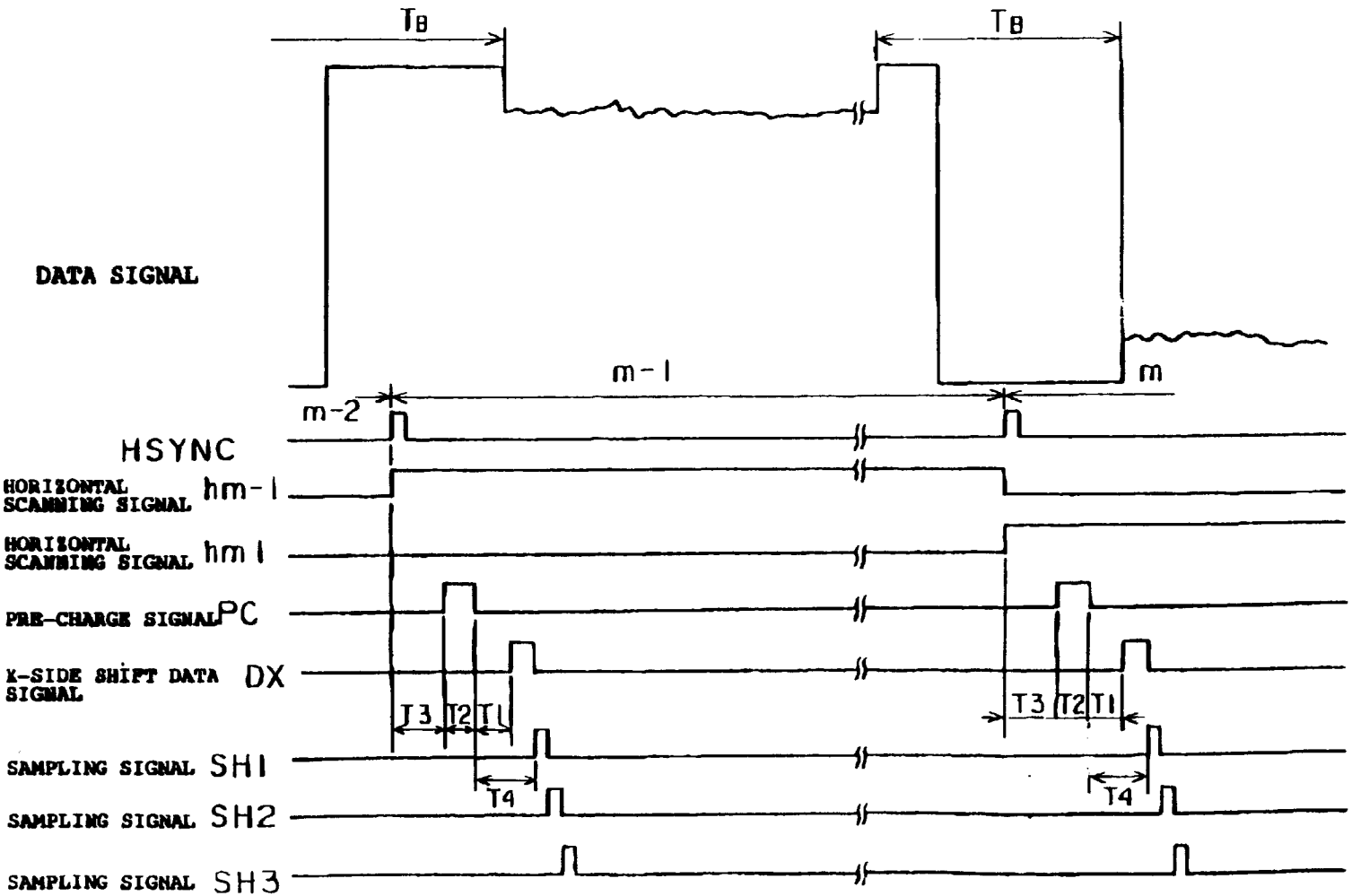
FIG. 1 is a timing chart for describing the pre-charging operation and data sampling operation in an active-matrix liquid display device according to the present invention.

This X-driver 104 also operates in the same manner as the timing chart shown in FIG. 4, and as shown in FIG. 1, generates the sampling signals SH1, SH2, and so forth, following input of the shift data signals DX.

Incidentally, in the event that the data processing circuit block 30 has a conventional phase expanding circuit, the output lines of the data processing circuit block 30 is the same number of output lines as the phase expanding number thereof. Accordingly, the X-driver 104 outputs sampling signals for sampling the data from the plurality of data output lines. In the subject description, a phase expanding circuit is supposed to sample and hold the image data signals as serial data according to a sampling period which is set according to a reference clock, and to expand the serial data at certain pixel intervals and then to output in parallel a plurality of data signals, which have been converted so that the one data output period thereof becomes to be integer multiple times of the reference clock.

The pre-charging switches 172*a*, 172*b*, and so forth are turned ON at a certain timing according to a pre-charge signal, and connect a first (negative polarity) pre-charge power supplying line 174*a* or a second (positive polarity) pre-charge power supplying line 174*b* to each of the data signal lines 112*a*, 112*b*, and so forth, thereby pre-charging the data signal lines 112.

The first pre-charging potential PV1 and the second pre-charging potential PV2 are switched each time a scanning signal line 110 is selected (each horizontal scan) and supplied to the first and second pre-charging switches 174*a* and 174*b*, via a pre-charging power supply switch 190. Incidentally, the switching timing of the pre-charging power supply switch 190 is set so as to be at least before the pre-charging switch 172 comes ON.

According to the present embodiment, polarity inversion driving is conducted, so during odd-numbered horizontal scanning periods for example, the odd numbered data signal lines 172*a*, 172*c*, and so forth are connected to the first pre-charging power supply line 174*a*, and the even numbered data signal lines 172*b*, 172*d*, and so forth are connected to the second pre-charging power supply line 174*b*. Also, during even-numbered horizontal scanning periods for example, the odd numbered data signal lines 172*a*, 172*c*, and so forth are connected to the second pre-charging power supply line 174*b*, and the odd numbered data signal lines 172*b*, 172*d*, and so forth are connected to the first pre-charging power supply line 174*b*. The details of this pre-charging operation will be described later.

That is to say, according to the present embodiment, polarity inversion driving is performed for each pixel according to the direction in which the scanning signal lines extend. Polarity inversion driving is performed for each line (each scanning signal line) according to the direction in which the data signal lines extend, and polarity inversion timing is set to match this. Incidentally, the case in which pre-charging is required means the condition that polarity inversion driving is performed at least for each line, but does not restrict to polarity inversion per pixel, only.

According to the liquid crystal apparatus of the first embodiment, during the pre-charging period T2 set within the blanking period (retracing period) TB shown in FIG. 1, each data signal line is pre-charged with the same polarity as the polarity of the voltage being applied to the pixels based on the data signals sampled during the subsequent sampling periods h1, h2, h3, and so forth.

According to the present embodiment, in order to perform sampling of the data signals in an accurate manner, the sampling periods h1, h2, h3, and so forth for the data signals are started after the pre-charging switches have completely turned OFF. In addition, the pre-charging period of the m'th horizontal scanning period is started after the switching elements of all of the pixels of the No. m−1 horizontal scanning period are completely turned OFF.

Accordingly, as shown in FIG. 1, the time T1 from the end of the pre-charging period T2 till to point at which the X-side shift data signals DX turns ON, and the time T3 from the end of the preceding horizontal scanning period till the start of the pre-charging period within the next horizontal scanning period, are set so as to solve first and second problems, as described below.

Figure 13:
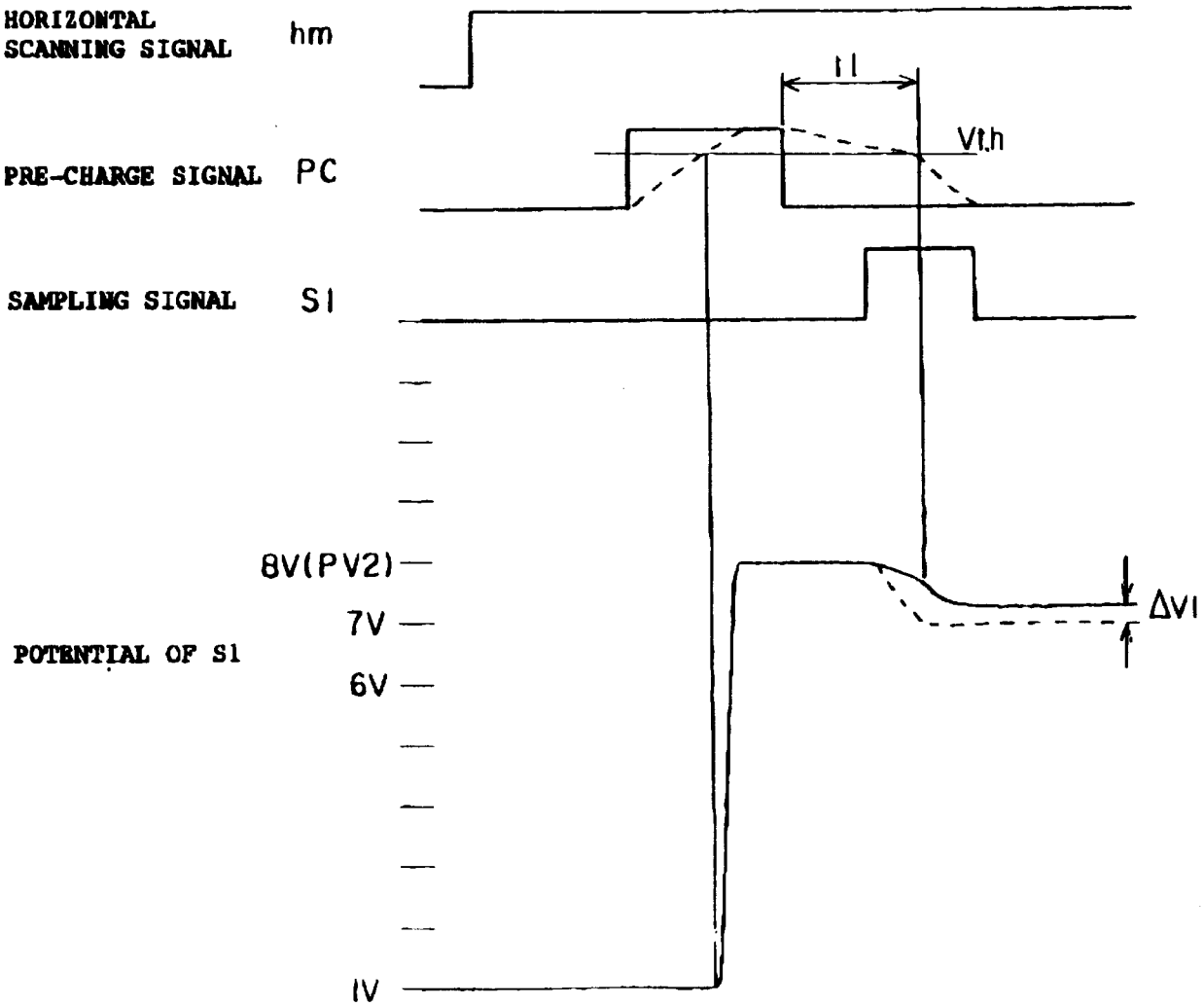
FIG. 13 is a timing chart for describing potential shift of the data signal line connected to the leading pixel.

FIG. 13 indicates a horizontal scanning signal hm, a pre-charging signal PC within the m'th horizontal scanning period, a sampling signal S1 for supplying data signal potential to the first data signal line, and the data signal potential of the data signal S1. Incidentally, in FIG. 13, the X-side shift data signal DX is omitted. This horizontal scanning signal hm is a signal which is applied to the gates of the switching element 114 of all of the pixels connected to the m'th scanning signal line 110 shown in FIG. 3.

After this horizontal scanning signal hm turns to "high", the pre-charging signal PC turns to "high". When this pre-charging signal PC is applied to the gates of all of the pre-charging switches 172, the waveform distortion is generated , as shown in FIG. 13 by dotted lines.

In the event that the waveform distortion occurs as shown in FIG. 13, voltage which exceeds the threshold voltage Vth of the TFT of the switch is further applied for a period of t1 to the gate of the pre-charging switch 172, even though the original pre-charging period has already ended. At this time, the sampling signal S1 for writing the data signal potential to the leading pixel, which is arranged in the horizontal scanning direction and shown in FIG. 3, out of the pixels connected to the m'th scanning signal line Hm, is turned On, firstly. Then, the sampling switch 106 connected to the data signal line S1 is turned ON. In the event that, as shown in FIG. 13, both of the pre-charging switch 172 and the sampling switch 106 which are connected to the data signal line S1 turn ON at the same time during the period t1, the potential of the data signal line S1 shifts as shown by solid lines in FIG. 13.

Now, provided that the potential of the data signal line S1 before pre-charging has been set to be a potential (1V) for performing black display at negative polarity voltage at the pixel. As shown in FIG. 13, by means of the pre-charging signal PC turning ON during the m'th horizontal scanning period, the potential of the data signal line S1 is pre-charged from 1V to the second pre-charging potential PV2 (8V). Let us assume that the sampling signal S1 subsequently turns "high", to supply data signal potential for performing white display of positive polarity voltage (7V) is supplied to the data signal line S1 via the sampling switch 106. At this time, the pre-charging switch 172 and sampling switch 106 connected to the data signal switch S1 are both ON state during the period t1. Accordingly, one end of the data signal line S1 is set at the second pre-charging potential PV2 (8V), and the other end is set at 7V, and the data signal line S1 is affected by both voltages.

Accordingly, the potential of the data signal line S1 is not discharged immediately from 8V to 7V as shown by the dotted line in FIG. 13, and the potential of the data signal line S1 at the time that both switches 172 and 106 sequentially go OFF becomes ΔV1 higher than the original 7V as shown by the solid line in FIG. 13. Accordingly, the pixel (m, 1) is affected by the second pre-charging potential, and becomes a darker display than the original white display in the event of a normally-white display. Also, in the event that the writing potential to the pixel (m, 1) is higher than the second pre-charging potential, the display shifts to be brighter than the original display.

Figure 3:
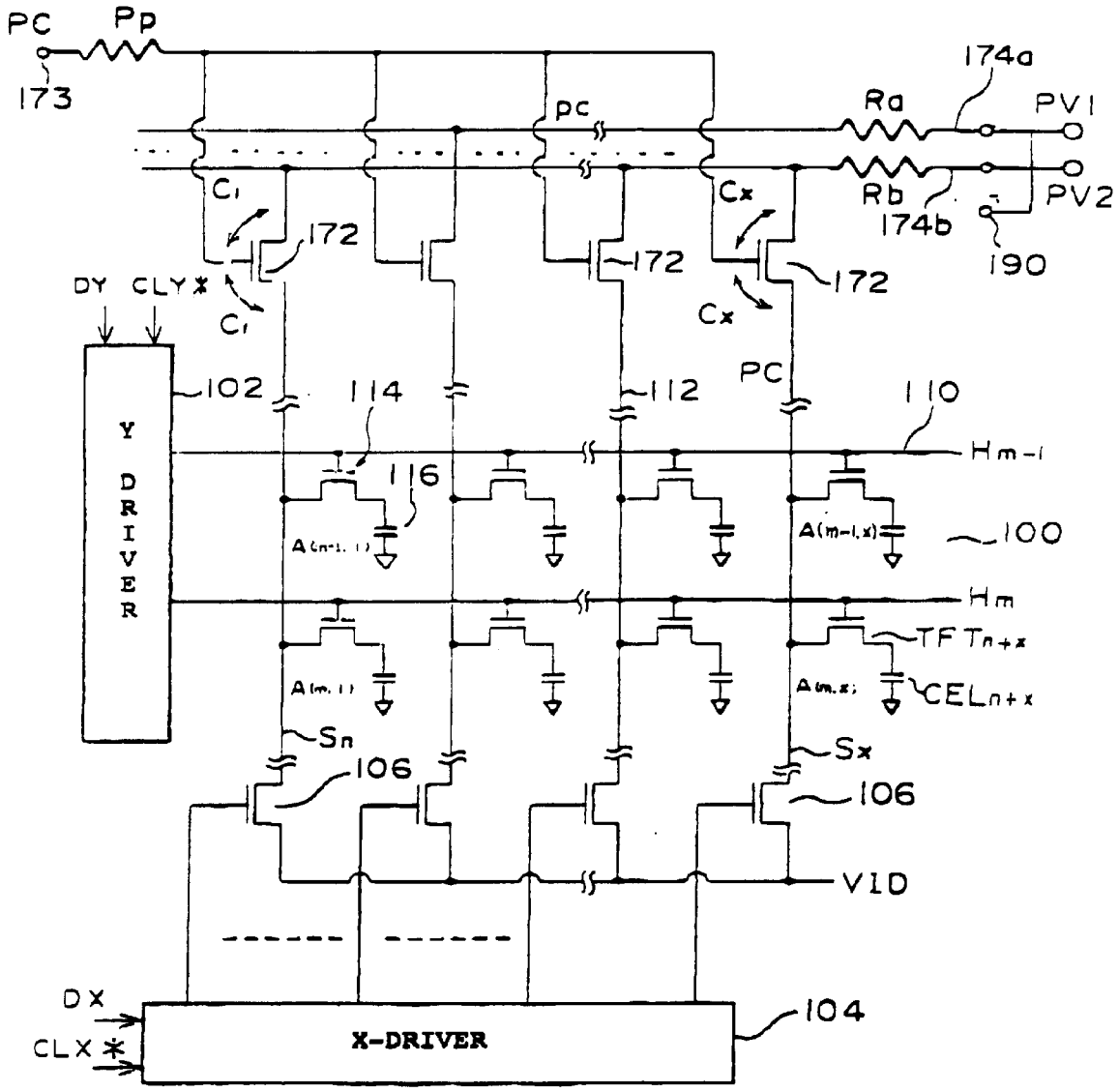
FIG. 3 is a diagram for describing the pre-charging switch and sampling switch of an active-matrix liquid crystal display apparatus according to the first embodiment of the present invention.

Such waveform distortion of the pre-charging signal PC occurs owing to time constants based on the later-described load. This load is the parasitic resistance Rb and the parasitic capacity Cb (not shown in the Figure) of the pre-charging power supply line 174*b* conducting with the pre-charging switch 172 connected to the data signal line S1 shown in FIG. 3, and the parasitic resistance Rp and the parasitic capacity Cp (not shown in the Figure) of the pre-charging signal supplying line 173 which supplies pre-charging signals PC. Incidentally, regarding other odd-numbered and even-numbered pre-charging switches 172 as well, time is wasted till completely coming ON, due to the parasitic resistances Ra and Rb and parasitic capacity of the pre-charging power supplying lines 174*a* and 174*b*, which are connected to the above mentioned pre-charging switches 172. Also, all of the pre-charging switches 172 have the source drain capacity linked to the gates. Accordingly, as shown in FIG. 3, parasitic capacity C1 is formed in the pre-charging switch 172 connected to the data signal line S1, and the time-constant based on this load also effects on. Also, all other pre-charging switches, e.g., the x'th pre-charging switch shown in FIG. 3, have occurrence of the parasitic capacity Cx. Accordingly, at the point that the pre-charging signal PC is input to each gate of each pre-charging switch 172, time is required for all of the pre-charging switches 172 to completely go OFF, so the waveform distortion occurs in the pre-charging period signal PC supplied to the gates of each of the pre-charging switches 172.

Figure 14:
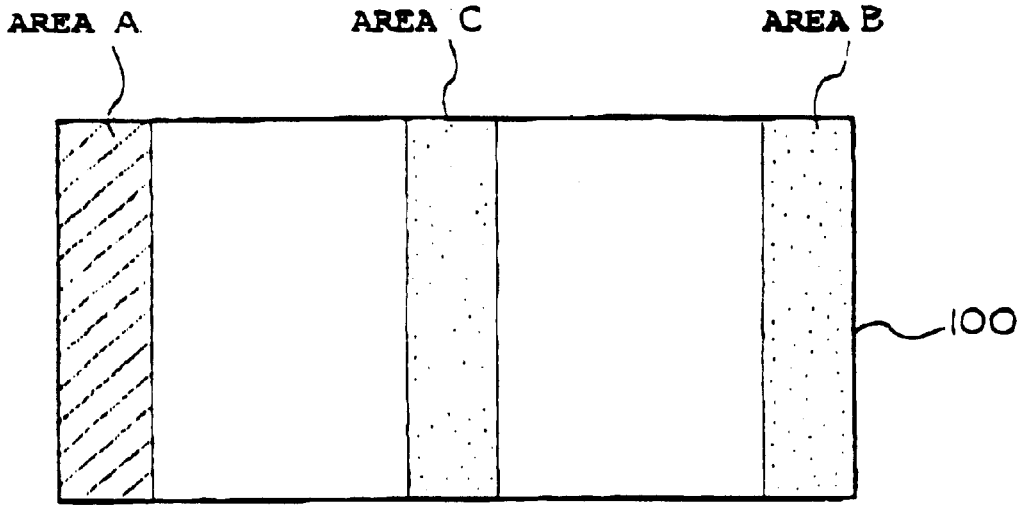
FIG. 14 is a schematic explanatory diagram for describing the area in which image quality deterioration occurs.

Such a phenomena occurs in the pixels which are positioned near the horizontal scanning direction Y-driver wherein a sampling period is set following lumped pre-charging, and the image quality drops in the pixel leading area A(m−1, 1) and A(m, 1) shown in FIG. 14.

Figure 15:
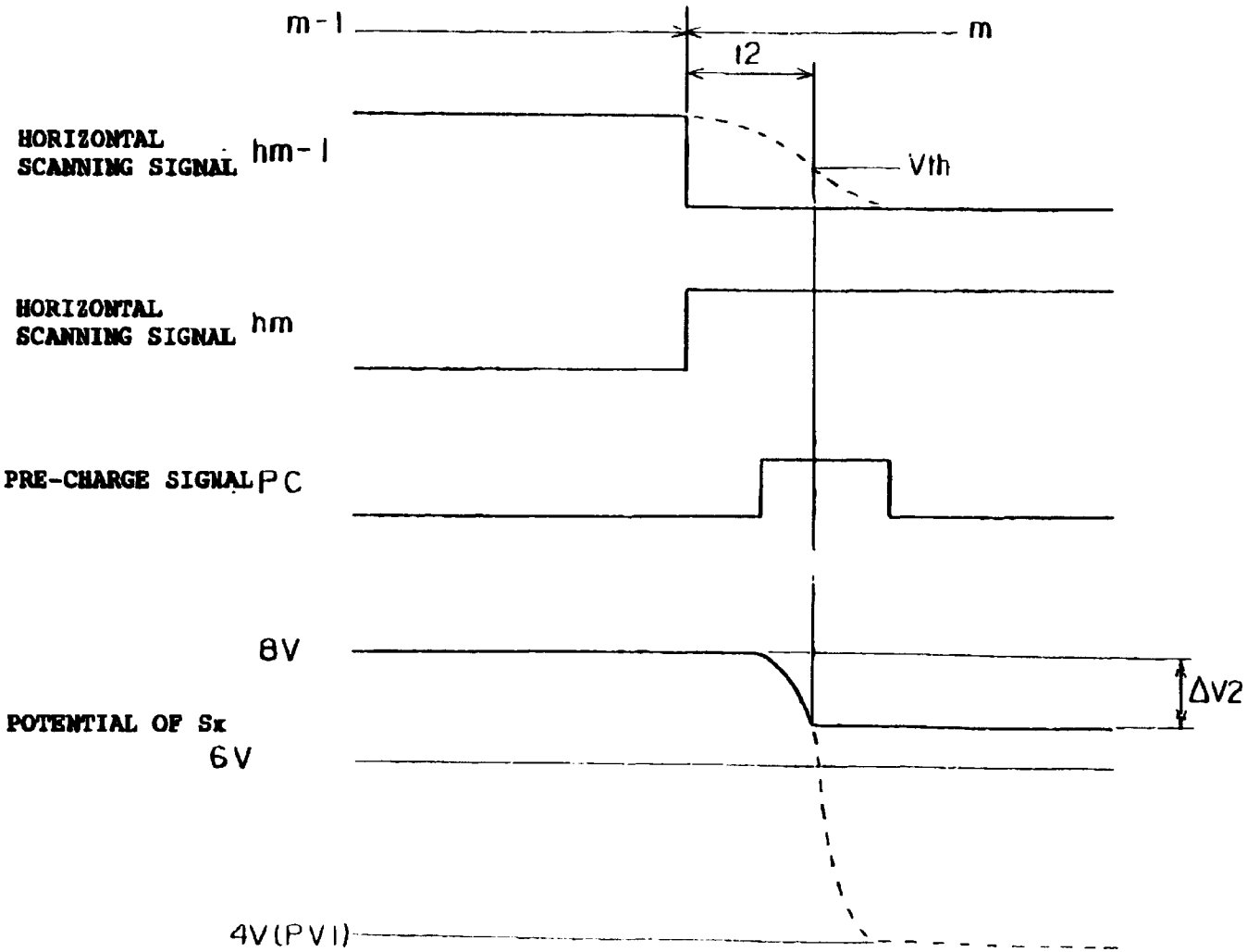
FIG. 15 is a timing chart for describing potential shift in the data signal line connected to the trailing pixel.

FIG. 15 shows horizontal scanning signals h(m−1) and h(m), a pre-charging signal PC within the m'th horizontal scanning period, and the potential of the x-th data signal line Sx shown in FIG. 3. The horizontal scanning signals h(m−1) and h(m) are each applied to the gates of all of the switching elements 114 connected to the No. m−1 and m'th scanning signal lines 110 shown in FIG. 3, thereby switching the switching elements 114 ON and OFF.

Now, in the event that the horizontal scanning signal h(m−1) is applied to the gate of the switching element 114 of the pixel (M−1, x) shown in FIG. 3, the the waveform distortion occurs as shown by the dotted line in FIG. 15. Here, the distortion occurring at the trailing edge of the horizontal scanning signal h(m−1) is going to be dealt with as problematic, and the distortion occurring at the pre-charging signal PC will be ignored.

In the event that the waveform distortion occurs as shown in FIG. 15, voltage which exceeds the threshold voltage Vth of the TFT continues to be applied further for the period t2 to the gate of the switching element 114 of the pixel (m−1, x) which is connected to the No. m−1 scanning signal line Hm−1, even though the original No. m−1 horizontal scanning period has already ended, and the m'th horizontal scanning period has already started. Consequently, the switching element 114 of the pixel (m−1, x) remains in the ON state even in period t2, and the pixel 120 connected to the drain of the switching element 114 is affected by the voltage of the x'th data signal line 112 (Sx) connected to the source of that switching element 114, and leaks.

Now, as show in FIG. 15, let us assume that, during the No. m−1horizontal scanning period, the data signal line Sx is charged with 8V data signal potential and that intermediate gray scale display is performed.

At this time, in the event that the pre-charging signal turns ON during the period t2, the data signal line Sx is pre-charged to be the first pre-charging potential Pv1 (4V), as shown by the dotted line in FIG. 15. That is to say, the data signal line Sx is discharged toward 4V from 8V, and in FIG. 15, the switching element 114 is turned OFF partway through the discharge.

Accordingly, the charge of the pixel (m−1, x) is leaked, and the charge voltage of the pixel 120 drops by ΔV2.

Consequently, in the case of a normally-white display, the display at pixel (m−1, x) becomes brighter than intended. Conversely, in the case of a normally-black display, the display at pixel (m−1, x) becomes darker than intended.

The waveform distortion of the horizontal scanning signal, which is the cause of this phenomena, occurs owing to time-constants of the load described below.

Figure 16:
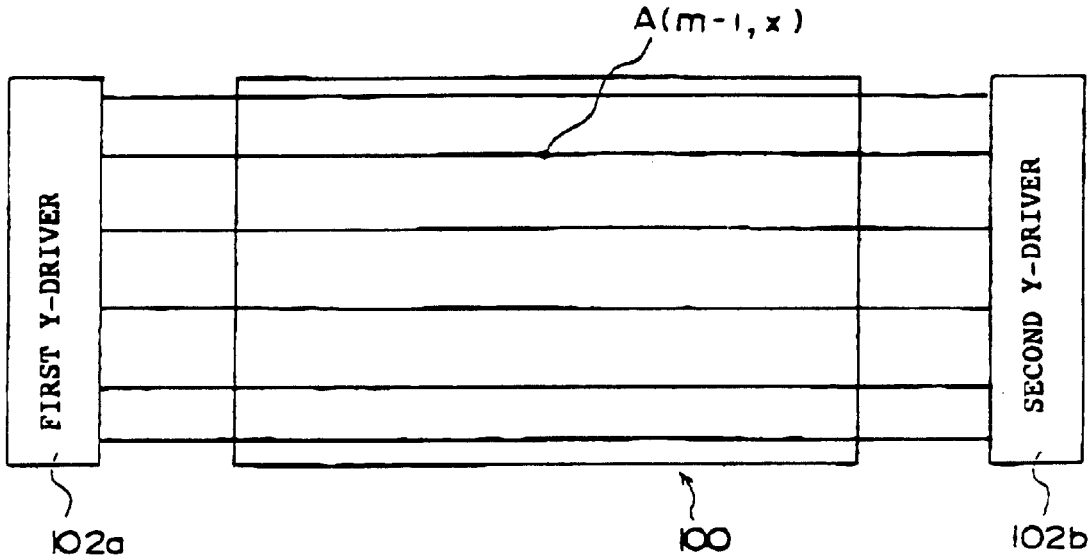
FIG. 16 is a schematic explanatory diagram illustrating a device having Y-devices to either end to the scanning signal line.

This load is the parasitic resistance and parasitic capacity of the scanning signal line 110. Now, each of the scanning signal lines 110 are formed of a poly-silicon layer for example, so the parasitic resistance and parasitic capacity thereof is greater as compared to the pre-charging power supply lines 174*a* and 174*b*, and the pre-charging signal supplying line 173, which are formed of aluminum, and there is a tendency for the transfer of the horizontal scanning signal to lag behind the transfer of the pre-charging signal. Particularly, the rising and falling of the gate potential of the switching element 114 at the pixel A(m−1, x), which is distant from the Y-driver 102, are distorted, and further, the timing of turning ON and OFF of the switching element is delayed because of the parasitic capacity Cx thereof. Now, in the event that the Y-driver 102 is connected to one end of the scanning signal line 110, the delay in transfer of the horizontal scanning signal is more remarkable according to the location of the pixels is nearer to other sides. Accordingly, in this case, the image quality deteriorates in the area B of FIG. 14. On the other hand, as shown in FIG. 16, in the event that the Y-drivers 102*a* and 102B are connected to both ends of the scanning signal line 110, image quality deteriorates in the image center area C as shown in FIG. 14.

That is to say, pre-charging is performed to all of the data signal lines 112 at a time, so the delay in the timing of the switching element 114 going OFF is more marked as the switching element 114 is far removed from the Y-driver 102, hence causing image deterioration such as described above.

Figure 5:
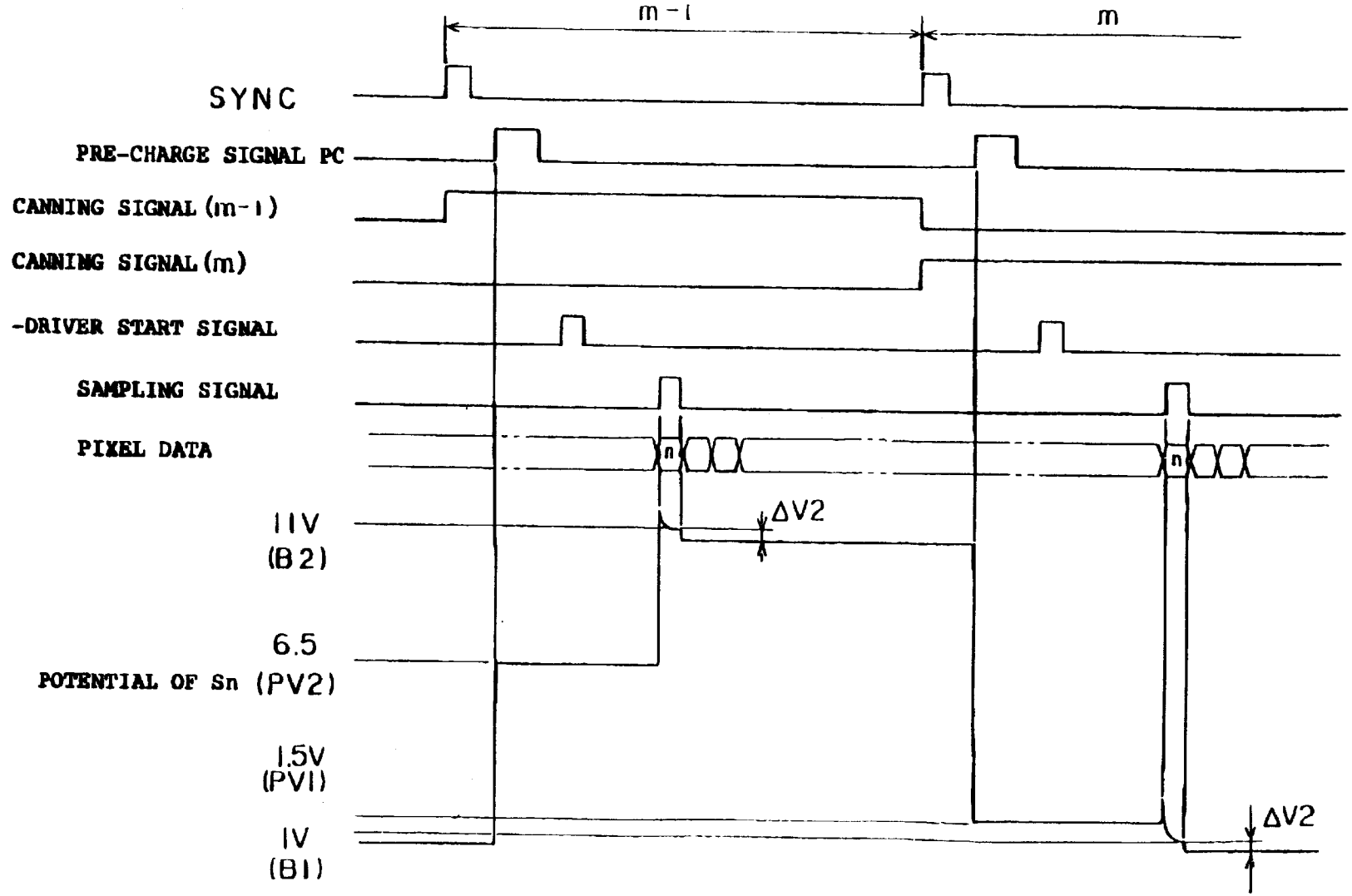
FIG. 5 is a timing chart for describing the potential of the data signal line connected to the leading pixel.
Figure 6:
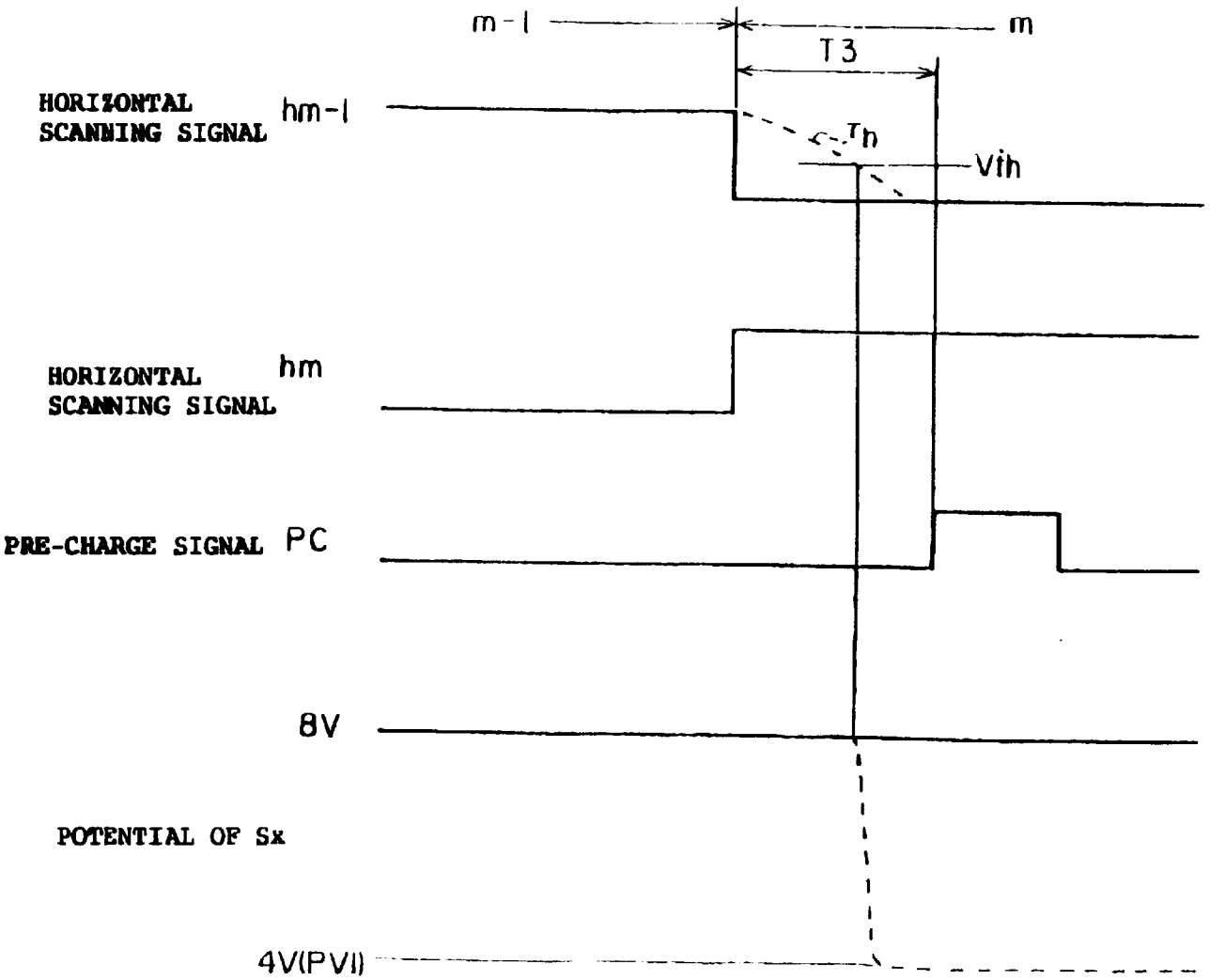
FIG. 6 is a timing chart for describing the potential of the data signal line connected to the trailing pixel.

FIG. 1 shows a timing chart indicating a liquid crystal apparatus according to an embodiment of the present invention, FIG. 5 is a timing chart wherein the first problem shown in FIG. 13 has been solved, and FIG. 6 is a timing chart wherein the second problem shown in FIG. 15 has been solved.

With to the liquid crystal apparatus according to the first embodiment, during the pre-charging period T2 set within the blanking period TB shown in FIG. 1, each data signal line is pre-charged with the same polarity as the polarity of the voltage being applied to the pixels based on the data signals sampled during the subsequent sampling periods h1, h2, h3, and so forth.

In the present embodiment, as shown in FIG. 1, following to that the No. m−1 horizontal scanning signal h(m−1) is turned ON, and the No. m−1 horizontal scanning period starts, the pre-charging signal PC turns to "high" following the period T3 elapses, and then the pre-charging period T2 starts. Also, following the end of the pre-charging period T2 within the blanking period TB, the sampling signal S1 of the leading pixel turns to "high" after elapsing of the period T1, and subsequently, other sampling signals S2, S3, and so forth turn to "high".

Now, in order solve the first problems shown in FIG. 13 and improve the image quality at the leading pixel (m, 1), the period T1 shown in FIG. 1 and FIG. 5 is set such that the relation between T1 and the time constant τp shown in the following Formula 1 is T1≧τp or T4>τp.

$$\tau p=\alpha 1\cdot Rb\cdot Cb+\alpha 2\cdot Rp\cdot Cp(\alpha 1,\ \alpha 2\text{:constants}) \qquad \text{Formula 1}$$

In the above Formula 1, Rp and Cp represent the parasitic resistance and parasitic capacity in the pre-charging signal supplying line 173, and Rb and Cb represent the parasitic resistance and parasitic capacity in the pre-charging power supplying line 174*b*.

With T1≧τp holding, after the horizontal scanning signal h(m−1) becoming low, i.e., after all of the switching elements 114 connected to the No. m−1 scanning signal line are turned OFF as shown in FIG. 5, the X-side shift data signal DX, which makes the sampling to the pixels being connected to the m'th scanning signal line Hm start, becomes active. Here, the sampling signal S1 for writing the data signal potential to the leading pixel A(m, 1) of the m'th scanning signal line Hm becomes active after the X-side shift data signal DX becomes active. Accordingly unlike the operation in FIG. 13, the sampling switch 106 and the pre-charging switch 172 connected to the data signal line S1 do not turn ON at the same time, in FIG. 5. Accordingly, as shown in FIG. 5, the data signal line S1 which had been pre-charged to the second pre-charging potential PV2 (8V) can be discharged to 7V, which is the original data signal potential, within the sampling period h1 which is stipulated by the sampling signal S1.

In the present embodiment, the X-side shift data signal DX always becomes active before the pre-charging signal S1 for the leading pixel becomes active, so if setting T1≧τp, it results in T4>τp is satisfied. However, in order to solve the above first problem, holding T4>τp alone is sufficient.

Next, in order to solve the second problem shown in FIG. 15 and improve the display quality at the pixel A(m−1, x), the period T3 shown in FIG. 1 and FIG. 6 is set to have the relation T1>τh with time constant τh in the following Formula 2.

$$\tau h=\beta 1\cdot Rh\cdot Ch+\beta 2\cdot Rx\cdot Cx(\beta 1,\ \beta 2;\ \text{constants}) \qquad \text{Formula 2}$$

In the Formula 2, Rh and Ch represent the parasitic resistance and parasitic capacity in the scanning signal line 110, and Rx and Cx represent the parasitic resistance and parasitic capacity in the switching element TFTx.

Thus, as shown in FIG. 6, the pre-charging signal PC for the m'th horizontal scanning period can be turned ON following that all of the switching elements 114 connected to the horizontal scanning signal h(m−1) is completely tuned OFF. Accordingly, the pixel A(m−1, x)of the position most removed from the Y-driver 102 does not receive undesirable effects from the first pre-charging potential PV1.

(Method for Setting the Periods T1 Through T3)

The periods T1 and T3 are set to be periods greater than the time constants τp and τh of the load that affects the transfer time of each of the signals, as described above.

Also, the period T2 is set to a length in which the data signal line 110 can be pre-charged to the first and second pre-charging potentials. Accordingly, the pulse width of the pre-charging signal PC equal with this period T2 is set so as to be an appropriate pulse width, based on the count of the dot clock signal CLK.

Figure 7:
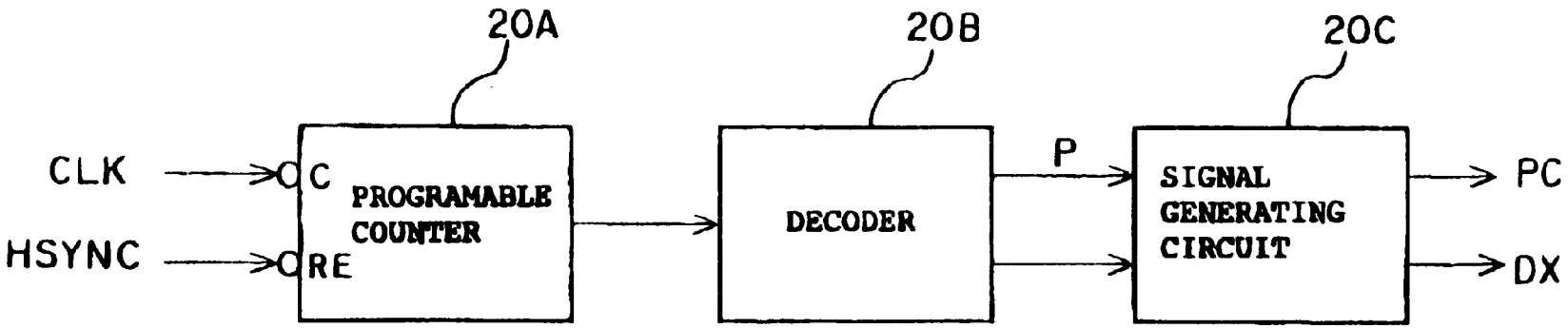
FIG. 7 is a block diagram of the adjusting circuit provided within the timing circuit block shown in FIG. 2.

These periods can be set by the adjusting circuit within the timing circuit block 20 shown in FIG. 7. This adjusting circuit has a programmable counter 20A which counts the reference clocks CLK and is reset by the horizontal synchronous signal HSYNC, and a decoder 20B which outputs pre-charging signals PC and X-side shift data signals DX. The decoder 20B can generate pre-charging timing signals P for setting the active period of the pre-charging signal PC shown in FIG. 1, by means of the programmable counter 20A outputting count values corresponding with the period T3 from the leading edge of the horizontal synchronizing signal HSYNC and the period T3+T2. Also, the decoder 20B can determine the timing of generating the X-side shift data signal DX shown in FIG. 1, by means the programmable counter 20A outputting a the count value corresponding with the period T3+T2+T1 from the rising of the horizontal synchronizing period HSYNC. The signal generating circuit 20C generates pre-charging signals PC and X-side shift data signals DX at the timing shown in FIG. 1, based on the output from the decoder 20B. Hence, consequently, the periods T1 through T3 can be set with the X-side shift data signals DX as a reference. Then, by making the count value described above to be variable, the periods T1 through T3 can be adjusted as desired. Incidentally, adjustment of the periods T1 through T3 is not restricted to changing of the count value of the counter 20A, but also may change the decoding analysis settings of the decoder 20B.

Final adjustment of the periods T1, T2, and T3 can be performed at the inspection step following assembly of the liquid crystal apparatus.

Thus, the periods T1 through T3 can be set to certain lengths, regardless of the driving frequencies of the liquid crystal apparatus. That is, by means of setting the periods T1 through T3 with the X-side shift data signals DX as a reference, the periods T1 through T3 are unchanged even of the driving frequencies change.

Figure 8:
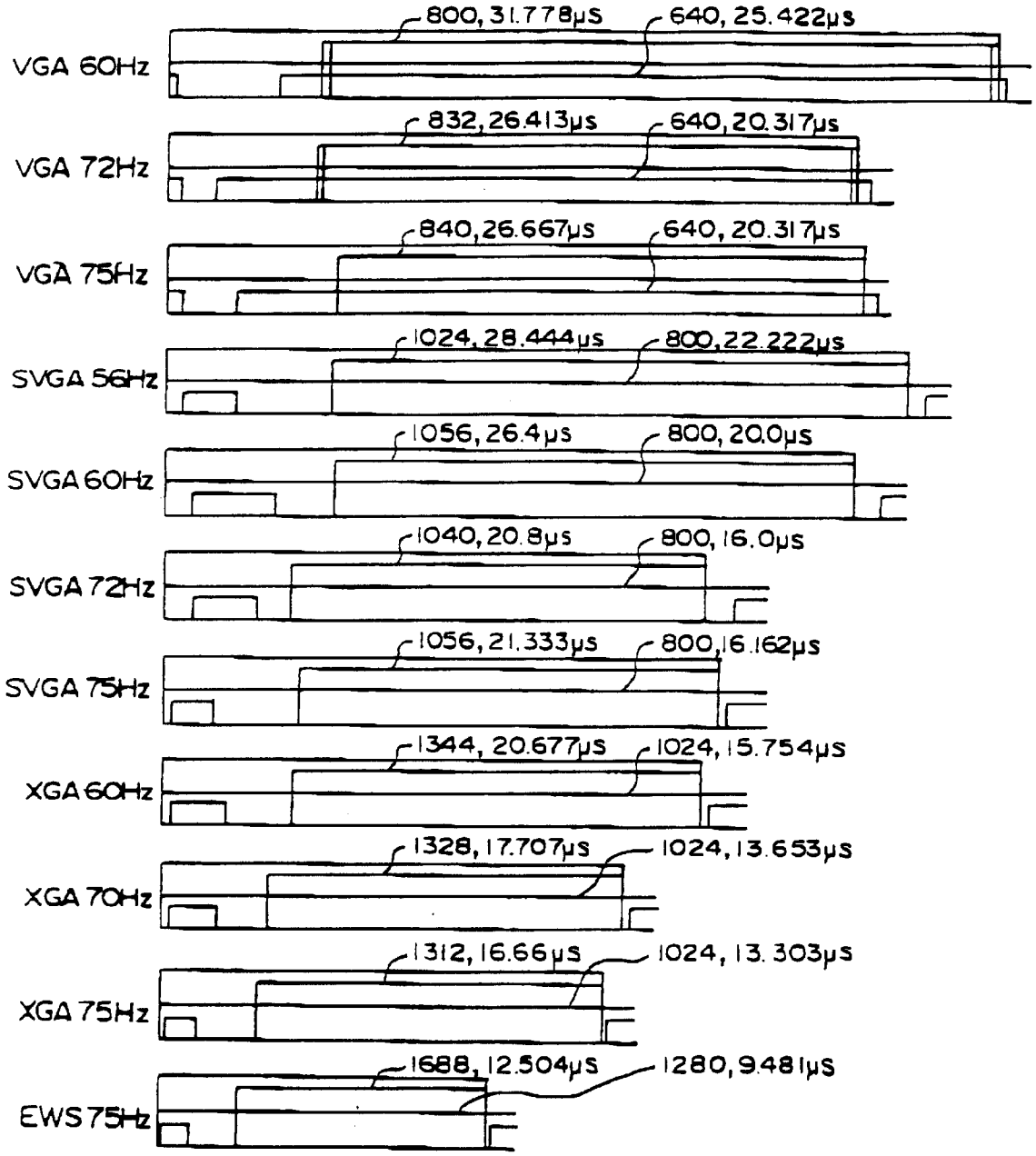
FIG. 8 is a schematic explanatory diagram for describing various types of video sources.
Figure 11:
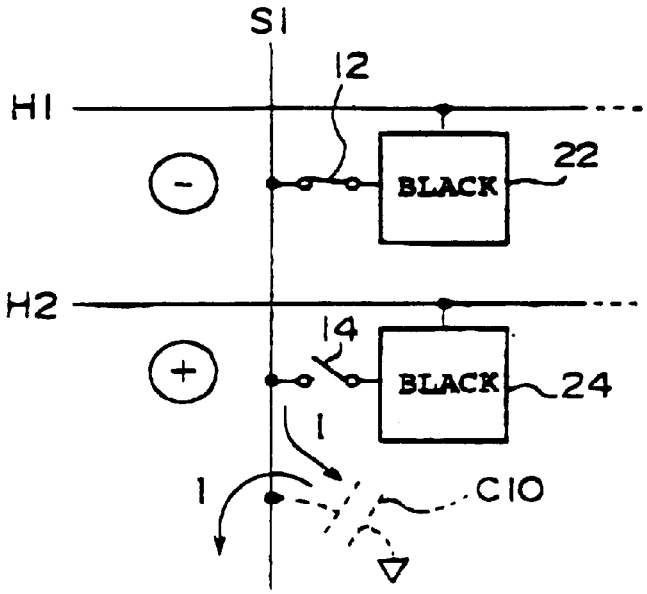
FIG. 11 is a schematic explanatory diagram illustrating two neighboring pixels connected to the same data signal line.
Figure 12:
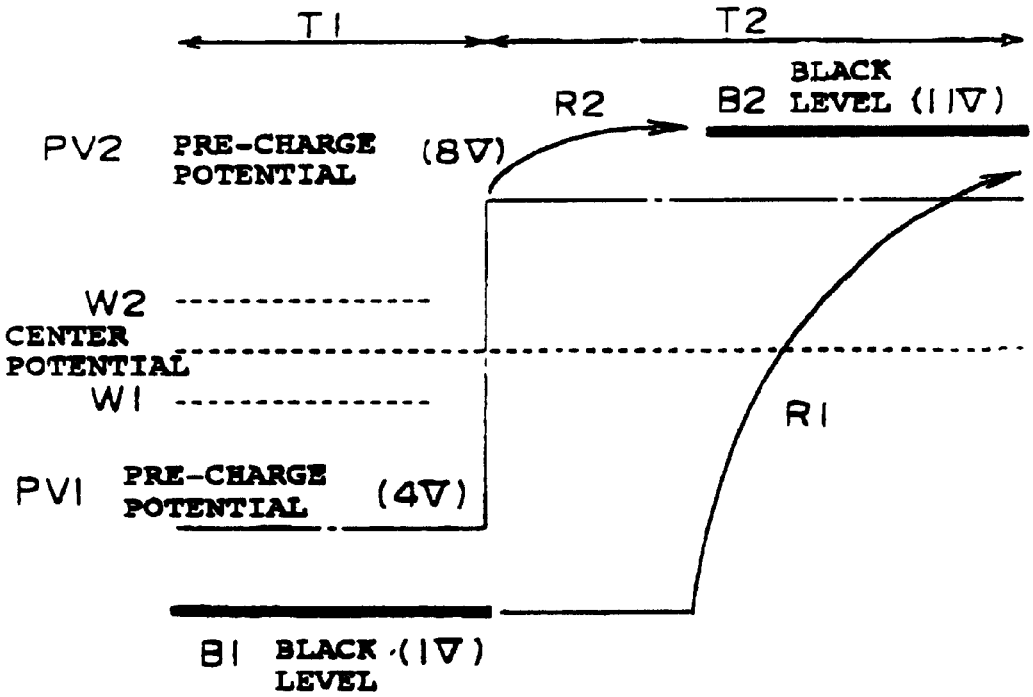
FIG. 12 is a properties diagram illustrating the potential of the data signal line when displaying black on both of the two pixels shown in FIG. 11.

For example, regarding the liquid crystal apparatus having image data signals (video source) of such various driving frequencies as shown in FIG. 8, the periods T1 through T3 are always set with the X-side shift data signals DX as a reference, so these driving frequencies can be dealt with easily. In each Figure which shows the combinations of the various liquid crystal apparatus and video sources (image data signals) shown in FIG. 8, the numerals represent the effective display period. Also, any video source can be easily applied to each liquid crystal driving method, by means of performing compressing and/or expansion of the data signal according to necessity in applying the video sources to the devices. For example, when applying an SVGA specifications video source to a VGA specifications liquid crystal apparatus, the video source can be changed to such which matches the VGA specifications liquid crystal apparatus, by means of performing digital image processing and image data compression. This data signal compression and expansion can be performed by a digital signal processing IC, and it is also possible that to provide the aforementioned circuit functions within the data processing circuit block 30, or to use an external IC.

Although the first embodiment has been described with the aforementioned first pre-charging potential PV1 as 8V and the aforementioned second pre-charging potential PV2 as 4V, the present invention is not restricted to such, and these value can be set as appropriate.

Also, the present embodiment has been described with an example that at the pixels A(m, 1) and A(m−1, 1), white display and intermediate gray scale display are performed, respectively, but all of the above-described problems can be solved, regardless of what sort of image display is being made.

Also, the present embodiment has been described with the positive polarity side black level potential as 11V, the white level potential as 7V, the negative polarity side black level potential as 1V, and the white level potential as 5V, but the present invention is not particularly restricted to such.

The present invention has been described under the presumption that the sampling switch is an N-type transistor which is turned ON with the input of a "high" level sampling period signal, but the present invention is not restricted to such; the sampling switch can be comprised of a P-type transistor, to receive the input of "low" level sampling period signals. This case can be easily realized by forming the sampling period signals having a signal waveform, which is the reverse to the aforementioned sample holding switch, in the X-driver. The switching element also can be formed of a P-type transistor.

Figure 17:
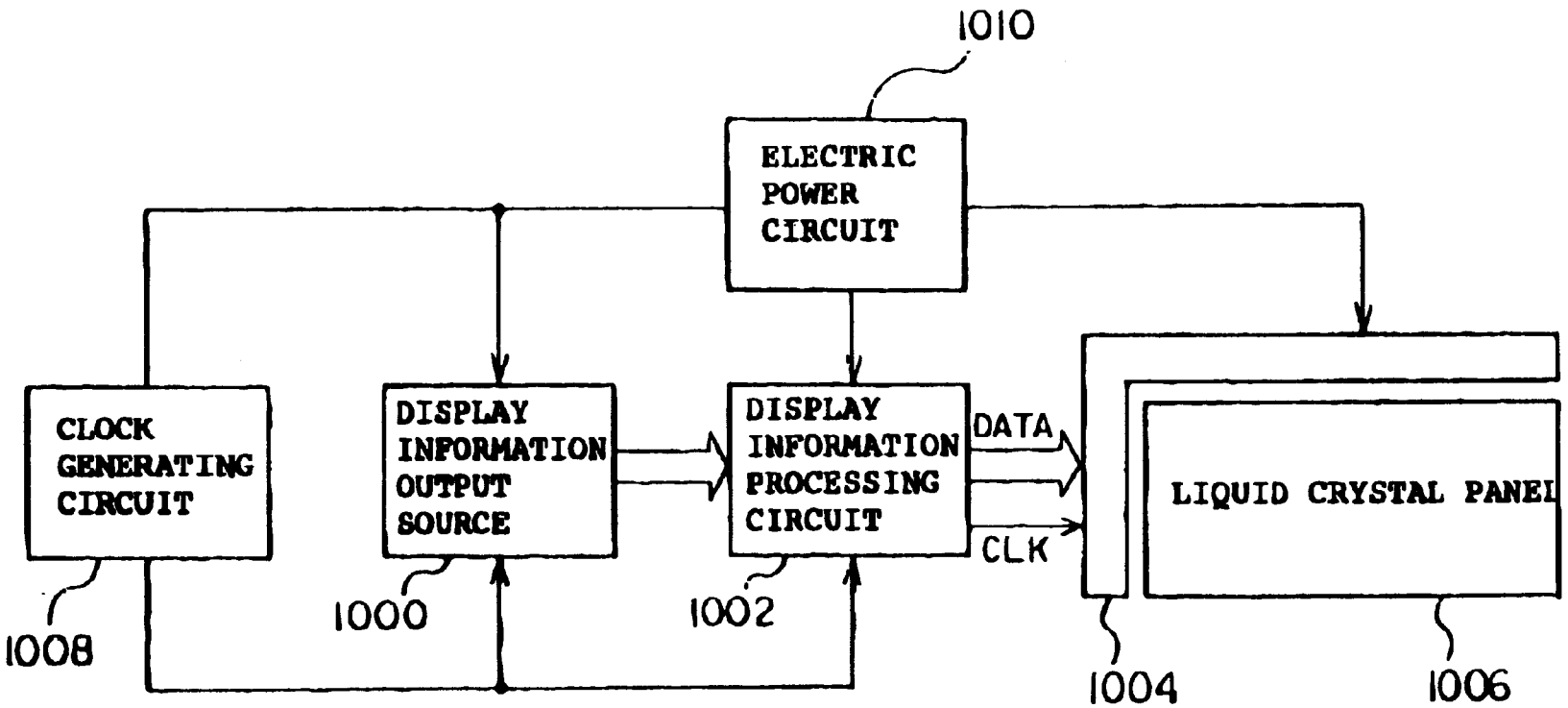
FIG. 17 is a schematic diagram illustrating electronic equipment comprised using the liquid crystal device according to the present invention.

Electronic equipment using the liquid crystal apparatus described in the above embodiment is comprised of a display information output source 1000, a display information processing circuit 1002, a display driving circuit 1004, a display panel such as a liquid crystal panel 1006, a clock generating circuit 1008, and a power source circuit 1010, as shown in FIG. 17. The information output source 1000 is comprised of memory such as ROM or RAM, and a synchronizing circuit for performing synchronous output with television signals, and outputs display information such as video signals based on clocks from the generating circuit 1008 which is equivalent to the above-described timing circuit block 20.

The display information processing circuit 1002 is equivalent to the above-described data processing circuit block 30, and processes and outputs display information based on clocks from the clock generating circuit 1008. This display information processing circuit 1002 is capable to include the gamma rotation circuits and the clamping circuits, etc. in addition to the amplifying/polarity inverting circuits, the phase expanding circuits, the rotation circuits, etc.

The display driving circuit 1004 is constructed having the above Y-driver 102, the X-driver 104, and the pre-charging driving circuit 160, or the X-driver 104, and drives the display of the pixel area 1006. The power source circuit 1010 supplies electrical power to each of the above circuits.

Figure 18:
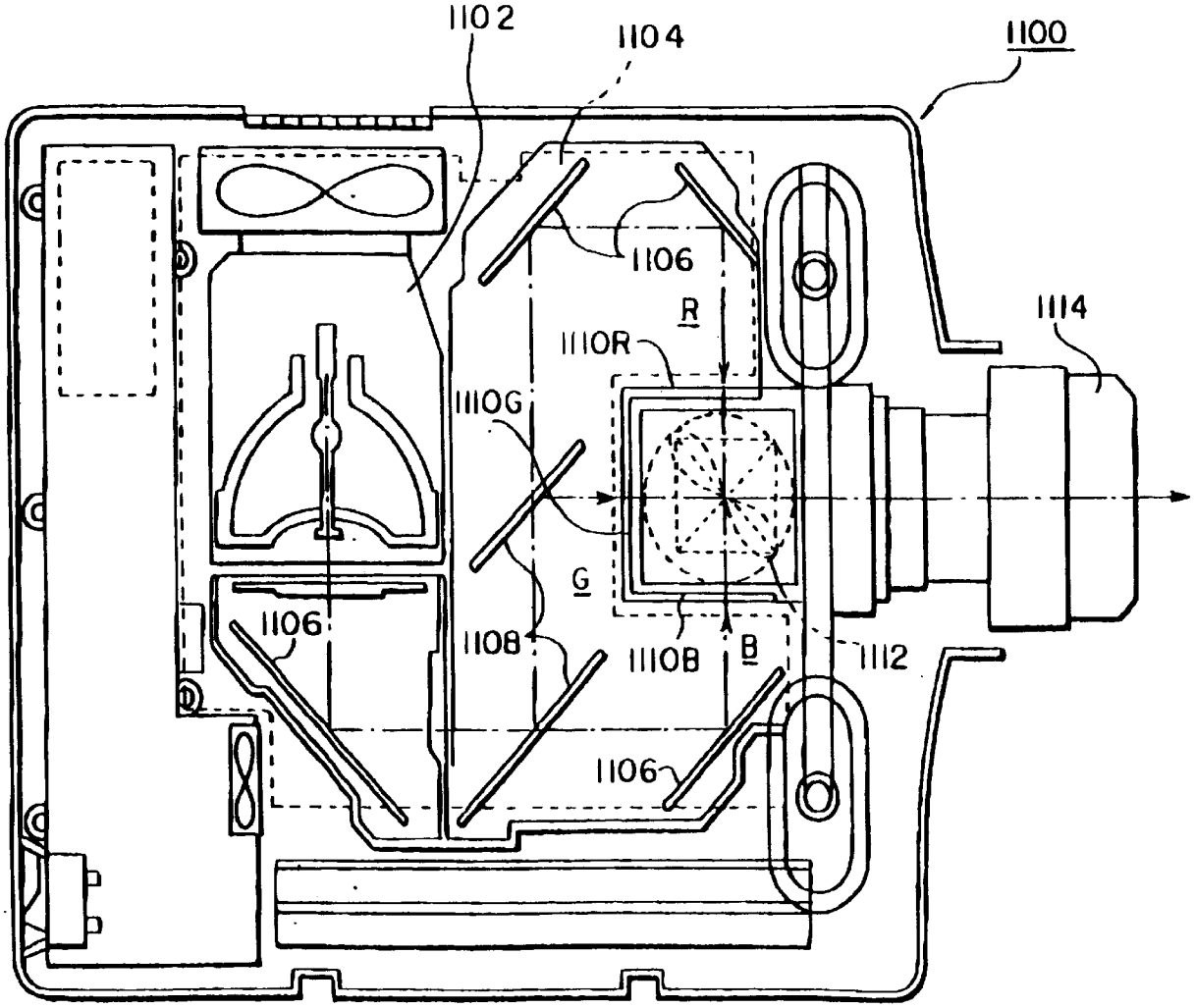
FIG. 18 is a schematic diagram of a liquid crystal projector to which the present invention is applied.
Figure 19:
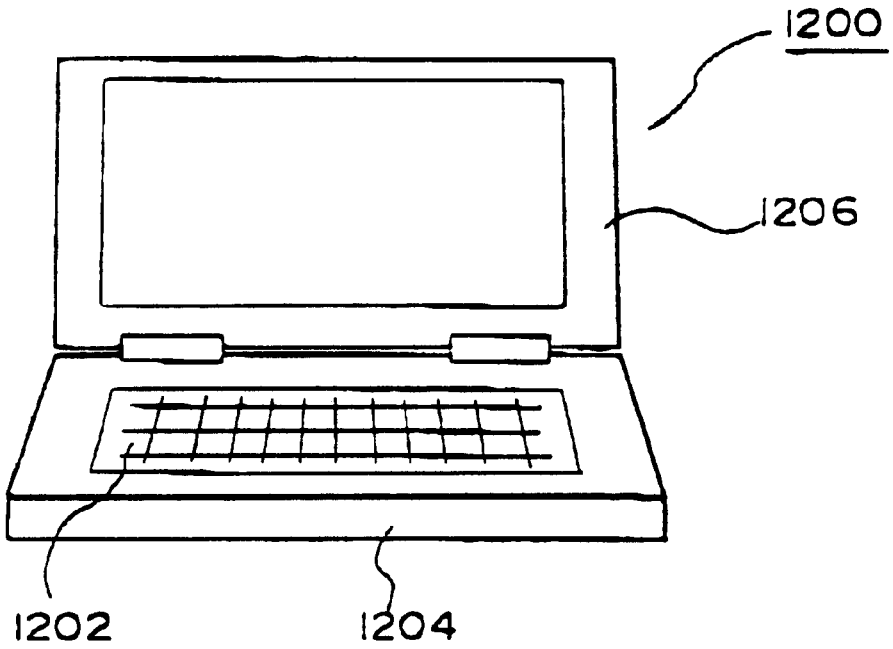
FIG. 19 is a schematic diagram of a personal computer (PC) to which the present invention is applied.

Equipment which can be thus configured includes the following examples: the liquid crystal projector shown in FIG. 18, the multimedia-capable personal computer (PC) shown in FIG. 19 and engineering workstation (EWS), pagers, cellular telephones, word processors, televisions, viewfinder-type or monitor-viewing-type video recorders, electronic notebooks, electronic calculators, car navigation apparatus, POS terminals, devices having touch-panels, and so forth.

The liquid crystal projector shown in FIG. 18 is a projection-type projector using a transmittance-type liquid crystal panel as a light valve, and includes, for example a three-plate prism-synthesis optical system. In FIG. 18, at the projector 1100, the projected light cast from the white-light source lamp unit 1102 is divided into the three primary colors R, G, and B within the light guide 1104 by a plurality of mirrors 1106 and two dichroic mirrors 1108. The light is modulated by three active-matrix liquid crystal panels 1110R, 1110G, and 1110B, which display the image of each color, and then enter into the dichroic prism 1112 from three directions.

At the dichroic prism 1112, the red R and blue B lights are bent by 90°, and the green light G proceeds directly, so an image of each of the colors is synthesized, and the color image is projected on a screen or the like through the projecting lens 1114.

The personal computer 1200 shown in FIG. 19 has a main unit 1204 provided with a keyboard 1202, and a liquid crystal display screen 1206.

Incidentally, the present invention is by no means restricted to the above embodiments, rather, various variations can be made within the scope and spirit of the present invention. For example, the present invention is not restricted to application to driving of the above-described various types of liquid crystal panels, but can also be applied to image display devices using electro-luminescence, plasma display, CRT, and so forth.

Also, the present embodiment has been described with an example wherein TFTs are used as the switching elements, but the switching elements may be two-terminal devices such as MIMs or the like. In this case, since a pixel is formed by connecting in series a two-terminal device and pixel between the scanning signal line and the data signal line, the differential voltage between the both signals lines is supplied to the pixel.

Also, in the above embodiment, TFTs are used as switching elements and glass substrate or quartz substrate is used as a substrate having the liquid crystal panel devices formed thereon, but semiconductor substrates may be used instead of them. In this case, MOS transistors are used as the switching elements instead of TFTs.

What is claimed is:

1. A liquid crystal apparatus that is driven by inverting a polarity of a voltage applied to a liquid crystal layer at a predetermined interval, said liquid crystal apparatus comprising:

a plurality of scanning signal lines;

a plurality of data signal lines crossing the plurality of scanning signal lines to form a plurality of pixels;

a plurality of switching elements electrically connected to the plurality of scanning signal lines, the plurality of data signal lines and the liquid crystal layer;

a scanning-side driving circuit that sequentially supplies horizontal scanning signals to said plurality of scanning signal lines to make a plurality of switching elements connected to at least one of said plurality of scanning signal lines turn on during a horizontal scanning period;

a plurality of sampling switching circuits that are connected to each of said plurality of data signal lines, that sequentially sample data signals during a sampling period and supply the sampled data signals to each of said plurality of data signal lines;

data-side driving circuit that supplies signals to said plurality of sampling switching circuits to set said sampling period; and a plurality of pre-charging switching circuits that simultaneously pre-charge each of said plurality of data signal lines with a pre-charge potential that has a same polarity as a voltage applied to the liquid crystal layer of said pixels based on said data signals, during a pre-charging period preceding said sampling period during which said data signals are sequentially applied to each of said plurality of data signal lines;

a time interval from a point at which said pre-charging period ends to a point that a sampling period of a leading sampling switching element is started is set to be longer than a signal transporting delay time of said sampling switching circuits connected to said data signal lines.

2. A projection-type display device, comprising:

a light source;

a liquid crystal apparatus according to claim 1 for modulating light from said light source; and a projecting optical device that projects modulated light.

3. Electronic equipment, having the liquid crystal apparatus according to claim 1.

4. The liquid crystal apparatus according to claim 1, said time interval being set to be longer than a sum of time-constants respectively based on a load of each of said pre-charging switching circuits.

5. The liquid crystal apparatus according to claim 1, said sampling signals being output by said data-side driving circuit after a shift data signal for starting said data-side driving circuit is activated, and said time interval that is longer than said signal transporting delay time being made to be the time from a point at which said pre-charging period ends to a point that said shift data signal is activated.

6. The liquid crystal apparatus according to claim 5, comprising an adjusting circuit that adjusts and sets said time interval, said adjusting circuit comprising:

a counter that counts reference clock signals and that is reset by horizontal synchronizing signals;

a decoder that decodes an output of said counter and outputs signals to set said time interval; and a signal generating circuit that generates said pre-charging signals and said shift data signals based on the output of said decoder.

7. The liquid crystal apparatus according to claim 6, said time interval being fixed by said adjusting circuits, regardless of a driving frequency.

8. The liquid crystal apparatus according to claim 1, further comprising a pair of substrates with said liquid crystal layer sandwiched therebetween, said plurality of sampling switching circuits being a plurality of switching elements formed on one of said pair of substrates.

9. The liquid crystal apparatus according to claim 8, said switching elements being one of a MOS transistor or thin-film transistor.

10. A method for driving a liquid crystal apparatus having a plurality of scanning signal lines, a plurality of data signal lines crossing the plurality of scanning signal lines to form a plurality of pixels, a liquid crystal layer, and a plurality of switching elements electrically connected with the plurality of scanning signal lines, the plurality of data signal lines, and the liquid crystal layer, said liquid crystal apparatus being driven by inverting a polarity of a voltage applied to said liquid crystal layer at a predetermined interval, said method comprising:

sequentially supplying to said plurality of scanning signal lines horizontal scanning signals to make a plurality of switching elements connected to at least one of said plurality of scanning signal lines turn on during a horizontal scanning period;

sampling data signals during a sampling period and supplying the sampled data signals to each of said plurality of data signal lines by a plurality of sampling switching circuits connected to each of said plurality of data signal lines; and simultaneously pre-charging each of said plurality of data signal lines with a pre-charge potential having a same polarity as a voltage applied to the liquid crystal layer of said pixels based on said data signals during a pre-charging period preceding said sampling period during which said data signals are sequentially supplied to each of said plurality of data signal lines, by a plurality of pre-charging switching elements connected to said plurality of data signal lines, a time interval from a point at which said pre-charging period ends to a point that a leading sampling period of said horizontal scanning period is started, is set to be longer than a signal transporting delay time of said pre-charging switching elements connected to said data signal lines.

* * * * *